US006817490B2

(12) United States Patent
Petit

(10) Patent No.: US 6,817,490 B2
(45) Date of Patent: Nov. 16, 2004

(54) FLUID PRODUCT DISPENSING PUMP

(75) Inventor: Ludovic Petit, Vitot (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 10/312,881

(22) PCT Filed: Jun. 14, 2001

(86) PCT No.: PCT/FR01/01861

§ 371 (c)(1),
(2), (4) Date: Mar. 5, 2003

(87) PCT Pub. No.: WO02/04128

PCT Pub. Date: Jan. 17, 2002

(65) Prior Publication Data

US 2003/0155378 A1 Aug. 21, 2003

(30) Foreign Application Priority Data

Jul. 7, 2000 (FR) ..... 00 08919

(51) Int. Cl.[7] ..... B05B 11/00

(52) U.S. Cl. ..... 222/321.9; 222/321.6; 239/333

(58) Field of Search ..... 222/320–321.3, 222/321.6–321.9, 336, 340, 341, 380, 382, 383.1, 383.3, 385; 239/329, 331, 333

(56) References Cited

U.S. PATENT DOCUMENTS 5,979,711 A 11/1999 Fuch et al.
5,992,704 A 11/1999 Jäger-Waldau
6,045,008 A * 4/2000 Gonzalez Fernandez et al. 222/153.13

FOREIGN PATENT DOCUMENTS

EP 0 309 001 3/1989

* cited by examiner

*Primary Examiner*—J. Casimer Jacyna
(74) *Attorney, Agent, or Firm*—Sughrue Mion, PLLC

(57) ABSTRACT

A fluid dispenser pump comprising a pump body (1) in which a piston (2) connected to an actuating rod (10) is slidably mounted in leaktight manner, said actuating rod (10) being mounted to slide inside an element (4), such as a ferrule, which is secured to the pump body (1), said fluid dispenser pump being characterized in that said actuating rod (10) includes a flexible outer tubular portion (11) that is in leaktight contact with said element (4), and a rigid inner tubular portion (12) that is concentric with said flexible outer tubular portion (11), the zone of contact between the inside of the ferrule (4) and the actuating rod (10) being leaktight regardless of the position of said actuating rod (10).

11 Claims, 2 Drawing Sheets

FLUID PRODUCT DISPENSING PUMP

Figure 1:
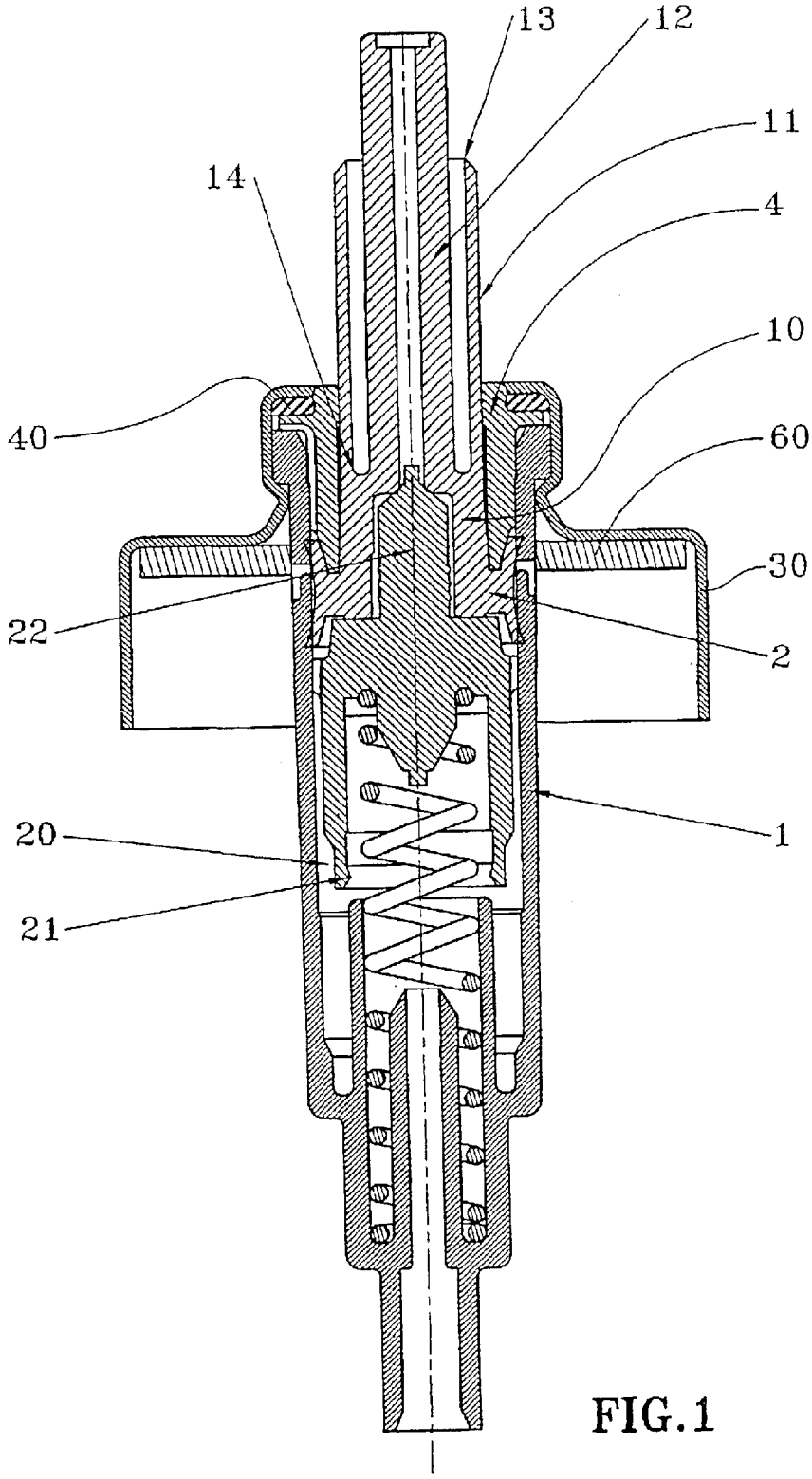

The present invention relates to a fluid dispenser pump, and more particularly to a novel implementation of the actuating rod of the pump.

A fluid dispenser pump conventionally comprises a pump body in which a piston connected to an actuating rod is slidably mounted in leaktight manner. The actuating, rod is mounted to slide inside an element that is generally fixed to the top edge of the pump body, and that may be a ferrule, a "turret", or the like. Depending on the type of pump, the interface between the actuating rod and the inside surface of the ferrule (or of the element used as the ferrule) can be leaktight or otherwise. In particular, in fluid dispensers, which are either airless, or else have a venting hole located at a specific place, e.g. so as to put a suitable bacteria filter in it, the actuating rod is preferably mounted to slide in leaktight manner inside the ferrule. However, between two elements that are generally made of a relatively hard plastics material, leaktightness is not easy to obtain, and it is sometimes necessary to make provision for there to be a considerable amount of friction between the two elements in order to guarantee a certain level of leaktightness. In addition, with that type of pump, e.g. when it is designed to be used as a nasal dispenser, it can happen that the user does not exert a force that is exactly axial on the actuating rod, which either prevents the pump from being actuated or else degrades the leaktightness between the actuating rod and the ferrule.

An object of the present invention is to provide a fluid dispenser pump that does not reproduce the above-mentioned drawbacks.

In particular, an object of the present invention is to provide a fluid dispenser pump that guarantees excellent leaktightness between the actuating rod and the ferrule, or any other similar element co-operating with the actuating rod.

In addition, an object of the present invention is to provide a fluid dispenser pump that is simple and inexpensive to manufacture and to assemble.

Another object of the present invention is to provide a fluid dispenser pump that makes it possible for the pump to be actuated even when the user exerts a force that is not exactly axial on the actuating rod. In which case, it can be said that the pump procures a "ball-coupling effect." More particularly, an object of the present invention is to provide such a pump having a ball-coupling effect that also guarantees leaktightness between the actuating rod and the ferrule.

The invention therefore provides a fluid dispenser pump comprising a pump body in which a piston connected to an actuating rod is slidably mounted in leaktight manner, said actuating rod being mounted to slide inside an element, such as a ferrule, which is secured to the pump body, said fluid dispenser pump being characterized in that said actuating rod includes a flexible outer tubular portion that is in leaktight contact with said element, and a rigid inner tubular portion that is concentric with said flexible outer tubular portion, the zone of contact between the inside of the ferrule and the actuating rod being leaktight regardless of the position of said actuating rod.

In a first embodiment of the invention, the flexible outer tubular portion has a first axial end that is free, and a second axial end that is secured to or integral with said actuating rod and in particular integral therewith.

In a second embodiment of the invention, both of the axial ends of the flexible outer tubular portion are secured to or integral with the actuating rod and in particular integral therewith.

Advantageously, a metering chamber is defined between an inlet valve and an outlet valve, the space between the outer tubular portion and the inner tubular portion of the actuating rod being part of said metering chamber.

The present invention also provides a fluid dispenser device including a pump as defined above.

Figure 2:
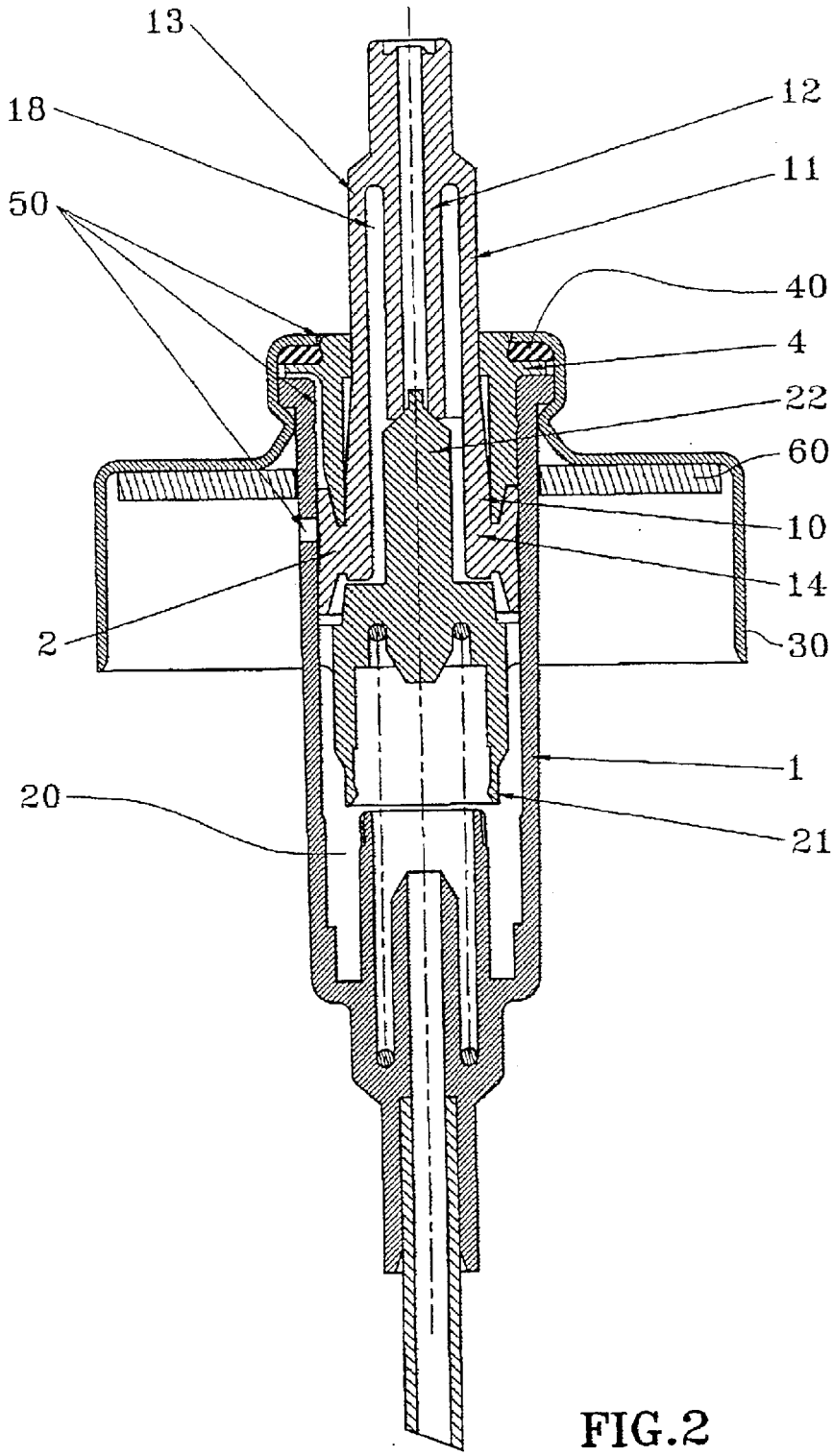

Other characteristics and advantages of the present invention will appear more clearly on reading the following detailed description of two embodiments of the present invention, given by way of non-limiting example and with reference to the accompanying drawings, in which:

FIG. 1 is a diagrammatic view in section of a first embodiment of a pump of the present invention; and FIG. 2 is a diagrammatic view in section of a second embodiment of a pump of the present invention.

As shown in the figures, the pump comprises a pump body 1 inside which a piston actuated by means of an actuating rod 10 is mounted to slide in leaktight manner. In general, the actuating rod 10 is connected to an element such as a pusher (not shown) on which the user presses to actuate the pump. A ferrule inside which the actuating rod 10 is slidably mounted is mounted on the top edge of the body of the pump 1. Said ferrule defines, in particular, the rest position of the piston 2. Naturally, pumps exist in which the actuating rod 10 is slidably mounted in an element secured to the pump body that is not a ferrule, and such implementation is naturally equivalent for the present invention.

In the present invention, the actuating rod 10 includes a flexible outer tubular portion 11 and an rigid inner tubular portion 12 that is concentric with said flexible outer tubular portion 11.

FIG. 1 shows a first embodiment of the present invention. In this first embodiment, the flexible outer tubular portion 11 has an axial end 13 that is free, namely its top end in the drawing, and another axial end 14 that is secured to or integral with the actuating rod 10. Preferably, the flexible outer tubular portion 11 is made integrally with the actuating rod 10. Such an implementation makes it possible to obtain excellent leaktightness between the inside surface of the ferrule 4 and the flexible tubular portion 11 of the actuating rod 10, regardless of the position of said actuating rod. This implementation also makes it possible to obtain a "ball-coupling effect", i.e. leaktightness and possibility of actuating the actuating rod even when the force exerted on said actuating rod 10 is not exactly axial. In such a case, the flexible outer portion 11 is deformed slightly while enabling the actuating rod and therefore the piston 2 to move relative to the pump body 1.

FIG. 2 shows a second embodiment of the present invention, in which both of the axial ends 13 and 14 of the flexible outer tubular portion 11 are secured to or integral with the actuating rod, and in particular they are made integrally therewith. In this case, the outer tubular portion 11 is less flexible than in the first embodiment shown in FIG. 1, but it nevertheless procures good leaktightness and a certain amount of "ball-coupling effect". An advantage of this embodiment lies in the space 18 that exists between the outer and the inner tubular portions 11, 12 of the actuating rod. As shown in FIG. 2, this space 18 is advantageously part of the metering chamber 20 of the pump, which chamber is defined between the inlet valve 21 and the outlet valve 22 of the pump. The fact that the space 18 between the two tubular portions 11 and 12 of the actuating rod 10 forms part of the metering chamber means that, during actuating, fluid pressurized in the metering chamber exerts radial pressure on the outer tubular portion 11, thereby further improving the leaktightness between the actuating rod 10 and the ferrule 4. It is thus the internal pressure of the fluid during actuating that improves leaktightness in this case. It should be noted that a certain amount of internal pressure also exists in the embodiment shown in FIG. 1, at the top valve 22, due to the small thickness of the actuating rod 10 thereat, where the junction is formed between the outer and the inner tubular portions. This internal pressure also improves the leaktightness between the actuating rod and the ferrule.

Naturally, the drawings in FIGS. 1 and 2 show particular embodiments of the pump, and in particular of the inlet and outlet valves 21, 22, and thus of the metering chamber. It is to be understood that the present invention is applicable to any type of pump and it is not limited to these embodiments used by way of example.

The present invention applies to any type of pump, and it is particularly advantageous in a pump having an air intake, as shown in the drawings. In "preservative-free" uses, a venting hole is provided in the fluid dispenser device, i.e. either in the reservoir, or in the pump, or indeed in the fixing ring for fixing the pump to the reservoir. To avoid any contamination of the fluid inside the reservoir, a suitable filter is provided at the venting hole. In the example shown in the drawings, the filter is disposed between the ferrule 4 and the fixing ring 30 for fixing the pump to the reservoir (not shown). The filter 40 therefore filters the air in the venting passageway. In this type of device, it is essential for all of the air entering the reservoir to pass through the filter. It is therefore an essential requirement to provide excellent leaktightness between the actuating rod and the ferrule when the venting passageway is situated outside the ferrule 4, as in the example shown in the drawings. With reference more particularly to FIG. 2, the air passageway is designated diagrammatically by the numerical reference 50, and it extends from the outside between the fixing ring 30 and the ferrule 4, then through the filter 40, and between the outside of the ferrule 4 and the inside of the pump body 1, so as finally to open out into the reservoir through an orifice 50 provided in the pump body by the piston 2. As can be seen in the figures, the orifice 50 is closed off by the piston 2 when the pump is in the rest position. This is particularly advantageous for a large number of uses, in which the fluid contained inside the reservoir must under no circumstances come into contact with the filter, which could give rise to contamination of the fluid. In the example shown, the orifice 50 in the pump body is closed off by the piston when the pump is in the rest position, and the filter is isolated from the inside of the reservoir by a neck gasket 60 which is mounted between the fixing ring 30, the pump body 1, and the reservoir (not shown). In this case, the neck gasket 60 is mounted in leaktight manner about the pump body 1, thereby preventing any contact between the fluid and the filter 40.

Although the present invention is described with reference to two particular embodiments, it should be understood that various modifications and changes may be made to them without going beyond the ambit of the present invention as defined by the accompanying claims.

What is claimed is:

1. A fluid dispenser pump comprising a pump body (1) in which a piston (2) integral with an actuating rod (10) is slidably mounted in leaktight manner, said actuating rod (10) being mounted to slide inside an element (4), which is secured to the pump body (1), wherein said actuating rod (10) includes a flexible outer tubular portion (11) that is in leaktight contact with said element (4), and a rigid inner tubular portion (12) that is concentric with said flexible outer tubular portion (11), the zone of contact between the inside of the element (4) and the actuating rod (10) being leaktight regardless of the position of said actuating rod (10); and wherein in the flexible outer tubular portion is radially flexible.

2. A pump according to claim 1, in which the flexible outer tubular portion (11) has a first axial end (13) that is free, and a second axial end (14) that is secured to or integral with said actuating rod (10) and in particular integral therewith.

3. A fluid dispenser device including a pump according to claim 1.

4. The pump according to claim 1, wherein the element is a ferrule.

5. A fluid dispenser pump comprising a pump body (1) in which a piston (2) connected to an actuating rod (10) is slidably mounted in leaktight manner, said actuating rod (10) being mounted to slide inside an element (4), which is secured to the pump body (1), wherein said actuating rod (10) includes a flexible outer tubular portion (11) that is in leaktight contact with said element (4), and a rigid inner tubular portion (12) that is concentric with said flexible outer tubular portion (11), the zone of contact between the inside of the element (4) and the actuating rod (10) being leaktight regardless of the position of said actuating rod (10); and in which both of the axial ends (13, 14) of the flexible outer tubular portion (11) are secured to or integral with the actuating rod (10) and in particular integral therewith.

6. A pump according to claim 5, in which a metering chamber (20) is defined between an inlet valve (21) and an outlet valve (22), a space (18) between the outer tubular portion (11) and the inner tubular portion (12) of the actuating rod (10) being part of said metering chamber (20).

7. A fluid dispenser pump comprising a pump body (1) in which a piston (2) connected to an actuating rod (10) is slidably mounted in leaktight manner, said actuating rod (10) being mounted to slide inside an element (4), which is secured to the pump body (1), wherein said actuating rod (10) includes a flexible outer tubular portion (11) that is in leaktight contact with said element (4), and a rigid inner tubular portion (12) that is concentric with said flexible outer tubular portion (11), the zone of contact between the inside of the element (4) and the actuating rod (10) being leaktight regardless of the position of said actuating rod (10); and wherein the flexible outer tubular portion has two axial ends, and wherein each axial end of the flexible outer tubular portion is secured to and form an integral one-piece construction with the actuating rod.

8. A fluid dispenser pump comprising:

tubular element (4); and a pump body (1) comprising a piston (2) integral with an actuating rod (10), the actuating rod (10) slidably mounted to slide inside the tubular element in a leaktight manner throughout an operating range of the pump; and wherein the actuating rod (10) includes a flexible outer tubular portion (11) that is in leaktight contact with the tubular element (4), and a rigid inner tubular portion (12) that surrounded by the flexible outer tubular portion (11).

9. The pump according to claim 8, wherein the flexible outer tubular portion has two axial ends, and wherein each axial end of the flexible outer tubular portion is secured to and form an integral one-piece construction with the actuating rod.

10. The pump according to claim 8, wherein the a pump body and the actuating rod form an integral one-piece construction.

11. A pump according to claim 9, wherein a metering chamber (20) is defined between an inlet valve (21) and an outlet valve (22), a space (18) between the outer tubular portion (11) and the inner tubular portion (12) of the actuating rod (10) being part of the metering chamber (20).

* * * * *